US005791258A

United States Patent [19]

Hawthorne et al.

[11] Patent Number: 5,791,258

[45] Date of Patent: Aug. 11, 1998

[54] RAILWAY TRUCK WITH ELASTOMETRIC SUSPENSION

[75] Inventors: V. Terrey Hawthorne, Lisle; Robert D. Wronkiewicz, Park Ridge, both of Ill.

[73] Assignee: Amsted Industries Incorporated, Chicago, Ill.

[21] Appl. No.: 843,020

[22] Filed: Apr. 11, 1997

[51] Int. Cl.[6] ..... B61F 5/08

[52] U.S. Cl. ..... 105/198.7

[58] Field of Search ..... 105/197.05, 197.2, 105/198.7, 208

[56] References Cited

U.S. PATENT DOCUMENTS

| | | | |
|---|---|---|---|
| 2,242,212 | 5/1941 | Hankins | 105/198.7 |
| 3,003,432 | 10/1961 | Poundstone | 105/198.7 |
| 3,352,255 | 11/1967 | Sheppard | 105/198.7 |
| 3,517,620 | 6/1970 | Weber | 105/198.7 |
| 3,941,063 | 3/1976 | Cope | 105/198.7 |
| 4,352,509 | 10/1982 | Paton et al. | 105/198.7 |
| 5,095,823 | 3/1992 | McKeown, Jr. | 105/198.2 |

*Primary Examiner*—S. Joseph Morano

*Attorney, Agent, or Firm*—Edward J. Brosius; F. S. Gregorczyk; Stephen J. Manich

[57] ABSTRACT

A railway freight car truck is provided with an elastomeric suspension device between the bolster end and the sideframe bottom support. The elastomeric device is usually of a toroidal shape, and usually has a centrally located vertically extending opening. Positioning protrusions usually are provided from the bolster end and the sideframe bottom support that extend into the elastomeric device opening.

6 Claims, 4 Drawing Sheets

SPRING COIL PERFORMANCE

ELASTOMERIC SUSPENSION DEVICE PERFORMANCE

RAILWAY TRUCK WITH ELASTOMETRIC SUSPENSION

BACKGROUND OF THE INVENTION

Traditional three piece railway freight car trucks are comprised of three basic structural components. These components are two laterally spaced sideframes receiving a bolster extending laterally between the two sideframes. Each sideframe has a central pocket including a bottom support member. A spring group is received on the bottom support member to in turn support the end of the bolster. Snubbing devices such as friction shoes are located between the interface of the sideframe and the sloped faces of the bolster ends to provide damping for oscillations of the spring group. A typical three piece freight car truck is shown in U.S. Pat. No. 5,095,823.

Each friction shoe in a three piece rail car truck usually includes a sloped surface which engages a complementary sloped surface on the bolster end and a vertical face which interacts with a complementary vertical surface on an inner sideframe column. The spring group itself can comprise up to thirteen or more springs each of which is either of a traditional steel coil construction or of a shock absorber type construction. There is a desire among rail freight car builders to decrease the weight of such freight cars to allow a greater weight of material to be hauled. Accordingly, it is desirable to re-engineer the interface between the bolster and the sideframe to possibly eliminate the entire spring coil group and friction shoe arrangement. It is also desirable to eliminate this arrangement due to wear at the interface between the friction shoe and the bolster slope face, and the sideframe vertical structure itself although the sideframe usually includes a vertical wear plate which can be replaced.

SUMMARY OF THE INVENTION

The present invention provides a railway freight car with an improved interface between the bolster and the supporting sideframes. The traditional coil spring and snubber group are replaced by an elastomeric suspension. The interface may also include a spacing structure to support the elastomeric suspension. The spacing structure itself usually comprises a cast steel or fabricated steel structural device placed on the bottom support member of each sideframe. This spacing structure would include a top and bottom piece joined by appropriate structural supports such as four outer walls and cross-bracing. The elastomeric suspension itself is usually of a general toroidal shape and usually includes a centrally located opening. The elastomeric suspension could also be formed without the central opening and could also be of various shapes including cylinders, cubes, hyperbolic or other structures. Appropriate protrusion devices may be located on either the bottom support member of the sideframe itself or on the spacing structure itself to protrude into the opening in the elastomeric suspension. A similar positioning protrusion may extend downwardly from a bottom surface of the bolster end to be received in the upper portion of the opening on the elastomeric suspension.

The weight savings of the elastomeric suspension arrangement of the present invention compared to a traditional coil spring and friction shoe arrangement would be in the neighborhood of 300 lbs. for each coil spring friction shoe arrangement. This would amount to two such savings per rail car truck or a total of four such weight savings per freight car total or a total savings of about 1,200 lbs. per freight car.

The elastomeric suspension device of the present invention is designed to provide the vertical stiffness and damping for the bolster received in the two sideframes of a three piece railway truck. The traditional coil spring and friction shoe arrangement is designed to address the two conditions most often experienced by a railway freight car, namely, an empty condition and a fully loaded condition. Accordingly, the elastomeric suspension device of the present invention was found to perform as needed in a railway freight car when those two extreme loading conditions were factored into the design and performance of the elastomeric suspension device. In fact, the elastomeric suspension device of the present invention is superior to the traditional coil spring and friction shoe arrangement when the overall lower height and less vertical travel from empty to loaded freight car conditions are considered.

DETAILED DESCRIPTION OF THE INVENTION

Figure 1:
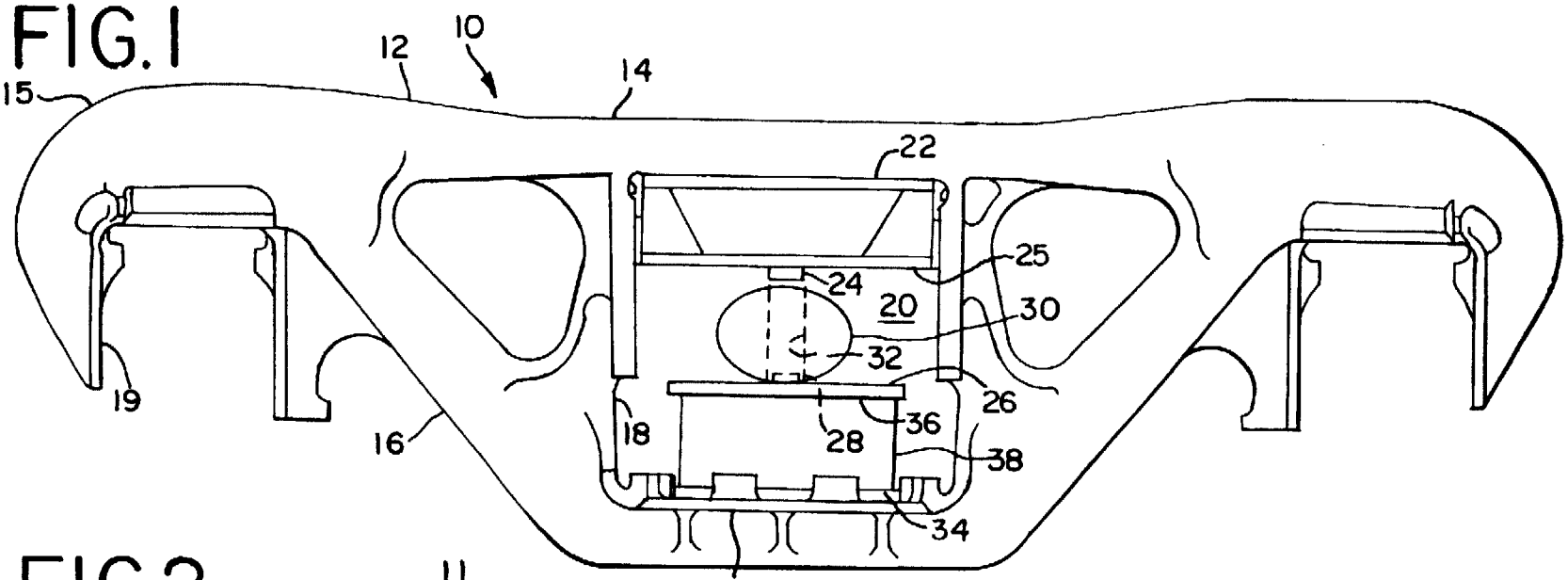
FIG. 1 is a side view of the freight car suspension structure of the present invention with the bolster in a raised position including a separate spacing structure.

Referring now to FIG. 1 of the drawings, a side view of a railway truck shown generally at 10 is provided. Cast steel sideframe 12 is shown as comprising a compression member 14 extending for the longitudinal length of the sideframe. Pedestal ends 15 extend from the longitudinal ends of compression member 14 and include pedestal jaws 19 adapted to receive an axle bearing. Tension members 16 extend diagonally downward from compression member 14 and are joined by bottom support member 17 that extends laterally between the lower ends of tension members 16. As mentioned above, sideframe 12 is usually a unitary cast steel structure. Vertical columns 18 extend between bottom support member 17 and compression member 14 to thereby form a central pocket in sideframe 12. It is understood that each railway freight car truck comprises two such sideframes 12 that are spaced laterally from each other.

Bolster 22 is also usually a unitary cast steel structure that extends laterally between sideframes 12. The end of bolster 22 (shown in a raised position) includes a lower surface 25 from which a positioning protrusion 24 extends. Positioning protrusion 24 is usually a cylindrical structure that is positioned longitudinally in the center of bolster bottom surface 25.

Spacing structure 26 is either a unitary cast steel structure or a fabricated steel structure that includes a bottom flat section 34 and a top flat section 36. Other metal structural materials could also be utilized such as aluminum. The top and bottom flat sections are spaced and joined by structural components 38 that include outer walls with inner structural supports. The preferred shape of spacing structure 26 is square, but a rectangular configuration or a cylindrical round configuration could also be adapted to be received on sideframe bottom support 17.

Elastomeric suspension device 30 is a generally toroidal shaped structure that includes a centrally vertically extending cylindrical opening 32. The positioning protrusion 28, usually a cylindrical section, extends upwardly from the top of spacing structure 26. Positioning support 28 extends partially into elastomeric support opening 32, usually less than one-fourth the vertical distance. Positioning support 24 that extends downwardly from the bottom surface 25 of bolster 22 extends into a top portion of elastomeric suspension device opening 32, again usually less than one-fourth the distance. The reason for such one-fourth distance is to provide a solid stop or to limit vertical travel of bolster 22.

Figure 2:
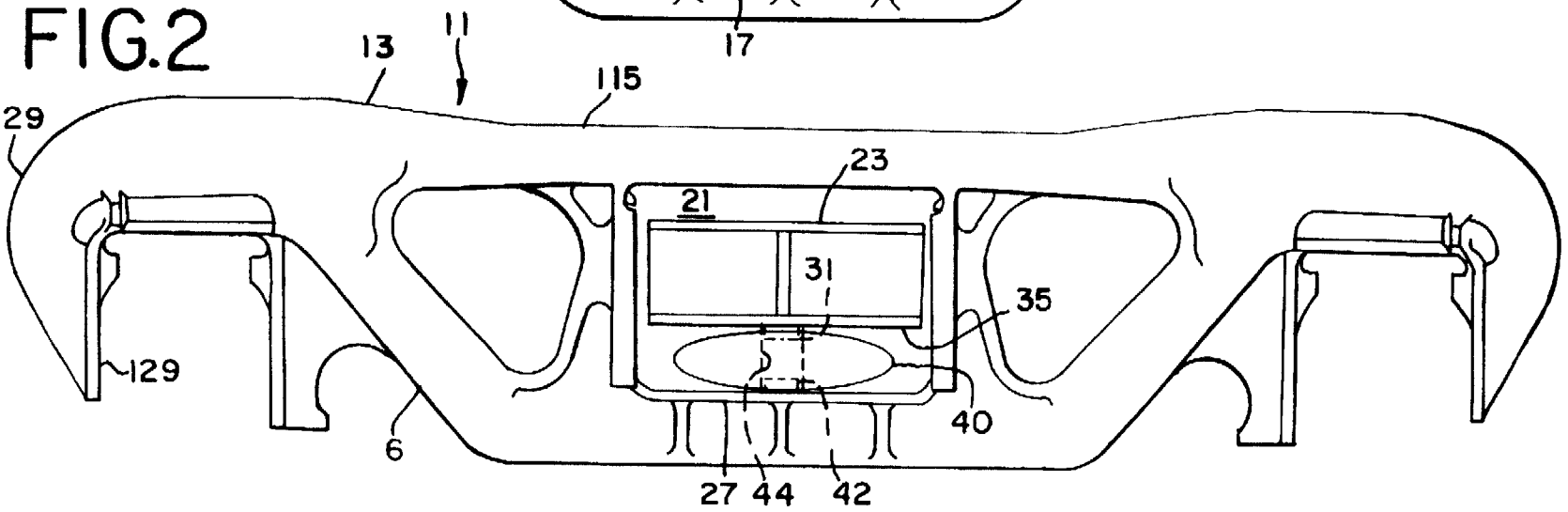
FIG. 2 is a side view of the freight car suspension structure of the present invention without a separate spacing structure and with a reduced height sideframe.

Referring now to FIG. 2, a railway truck 11 is shown that has a reduced height sideframe 13, such that separate spacing structure 26 is not required in the embodiment shown in FIG. 2. Sideframe 13 comprises compression member 115 extending for the longitudinal length of the sideframe. Pedestal ends 29 extend from the longitudinal ends of compression member 15 and include pedestal jaws 129 each adapted to receive an axle bearing. Tension members 6 extend diagonally downward from compression member 15 and are joined by bottom support member 27 that extends between the lower ends of tension members 6. Sideframe 13 includes bottom support member 27 that itself includes a positioning protrusion 42. Positioning protrusion 42 is usually a cylindrical section extending upwardly from a bottom support member 27.

An elastomeric suspension device 40 is provided in this embodiment. A similar centrally located vertically extending opening 44 is provided that is generally cylindrical in shape within elastomeric suspension device 40. Positioning protrusion 31 extending from the bottom of section 35 of bolster 23 extends into a top portion of elastomeric suspension device opening 44. Positioning protrusion 42 extending upwardly from bottom support member 27 of sideframe 13 extends directly into the lower portion of elastomeric suspension device opening 44.

Figure 3B:
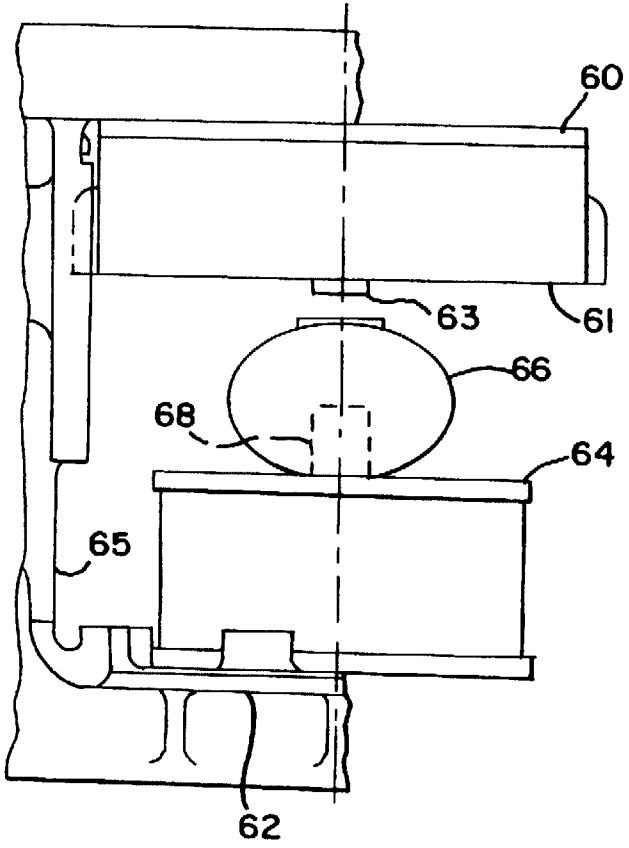
FIG. 3B is a partial side view of the freight car suspension structure of the present invention with the bolster in a raised position and with a positioning protrusion on the spacing structure and a stop extending from the bolster.
Figure 3A:
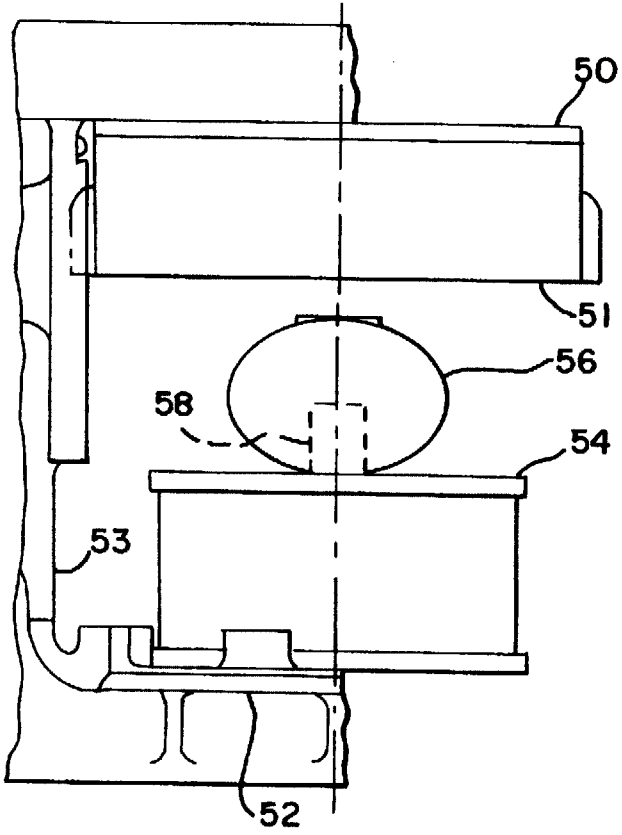
FIG. 3A is a partial side view of the freight car suspension structure of the present invention with the bolster in a raised position with a positioning protrusion only on the spacing structure.

Referring now to FIG. 3A, an alternative embodiment of the freight car suspension structure of the present invention is shown. Bolster end 50 is shown in a raised position in the bolster opening partially formed by sideframe bottom support member 52 and sidewall 53. Spacing structure 54 is of construction similar to spacing structure 26 described above, except that positioning protrusion 58 extends upwardly a greater distance, equal to about one-half the uncompressed height into an opening in elastomeric suspension device 56. Bottom side 51 of bolster 50 does not include a positioning support in the embodiment due to the extension of positioning protrusion 58.

Referring now to FIG. 3B, an alternative embodiment of the freight car suspension structure of the present invention is shown. Bolster end 60 is shown in a raised position in the bolster opening partially formed by sideframe bottom support member 62 and sidewall 65. Spacing structure 64 is of construction similar to spacing structure 26 described above, except that positioning protrusion 68 extends upwardly a greater distance, equal to about one-half the uncompressed height into an opening in elastomeric suspension device 66. Bottom side 61 of bolster 60 includes a positioning support stop 63 that extends downwardly only a short distance to about positioning protrusion 68 to thereby limit the downward travel of bolster 60.

Figure 4B:
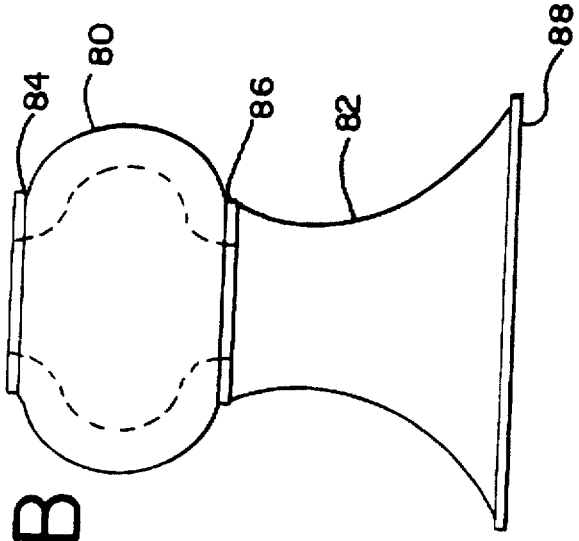
FIG. 4B is a side view of an elastomeric suspension device with an alternative combined support structure.
Figure 4A:
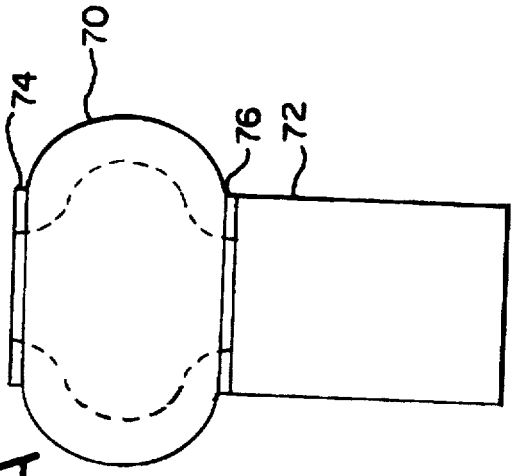
FIG. 4A is a side view of an elastomeric suspension device with a combined support structure.

Referring now to FIG. 4A, elastomeric suspension device 70 is shown as a typical toroidal shaped structure having a generally flat top portion with top plate 74 and a generally flat bottom portion with bottom plate 76. Support structure 72 is shown as a generally cylindrical structure having a flat top portion engaging bottom plate 76 and a generally flat bottom portion 78 adapted to be received on the bottom support member of a sideframe. Support structure 72 could be comprised of fabricated steel, cast steel, fabricated aluminum, cast aluminum or any of the structural plastics with appropriate side walls and internal cross bracing as may be needed.

Referring now to FIG. 4B, elastomeric suspension device 80 is shown as a typical toroidal shaped structure having a generally flat top portion with top plate 84 and a generally flat bottom portion with bottom plate 86. Support structure 82 is shown as a hyperbolic structure having a flat top engaging bottom plate 86 and a flat bottom 88 adapted to be received on the bottom support member of a sideframe. Support structure 82 could be comprised of fabricated steel or aluminum, cast steel or aluminum or any of the structural plastics with appropriate side walls and internal cross bracing as may be needed.

Figure 5:
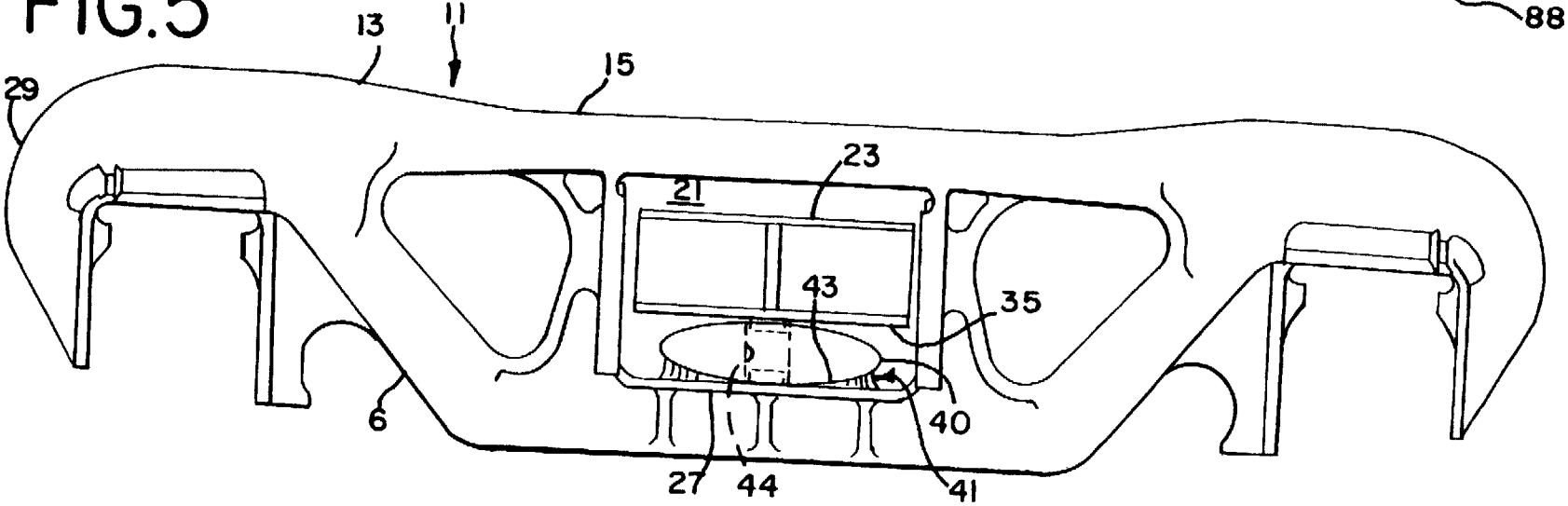
FIG. 5 is a side view of the freight car suspension structure of the present invention with an alternative elastomeric suspension device support.

Referring now to FIG. 5, a railway truck 11 is shown that is identical to the structure shown in FIG. 2, with certain exceptions. Structural support 41 is provided in the upper surface of bottom support member 27. Structural support 41 has a flat bottom portion that is received adjacent the upper surface of bottom support member 27. Structural support 41 also has a concave upper surface 43 that is adapted to complementarily receive the lower surface of elastomeric suspension device 40. No positioning protrusions extend from the lower surface of bolster 23 nor from the upper surface of structural support 41 in the shown embodiment, but such positioning protrusions can be provided if desired. Structural support 41 itself could be comprised of a cast steel or aluminum insert placed onto the upper surface of bottom support member 27, or structural support 41 could be comprised of a structural plastic.

Figure 6:
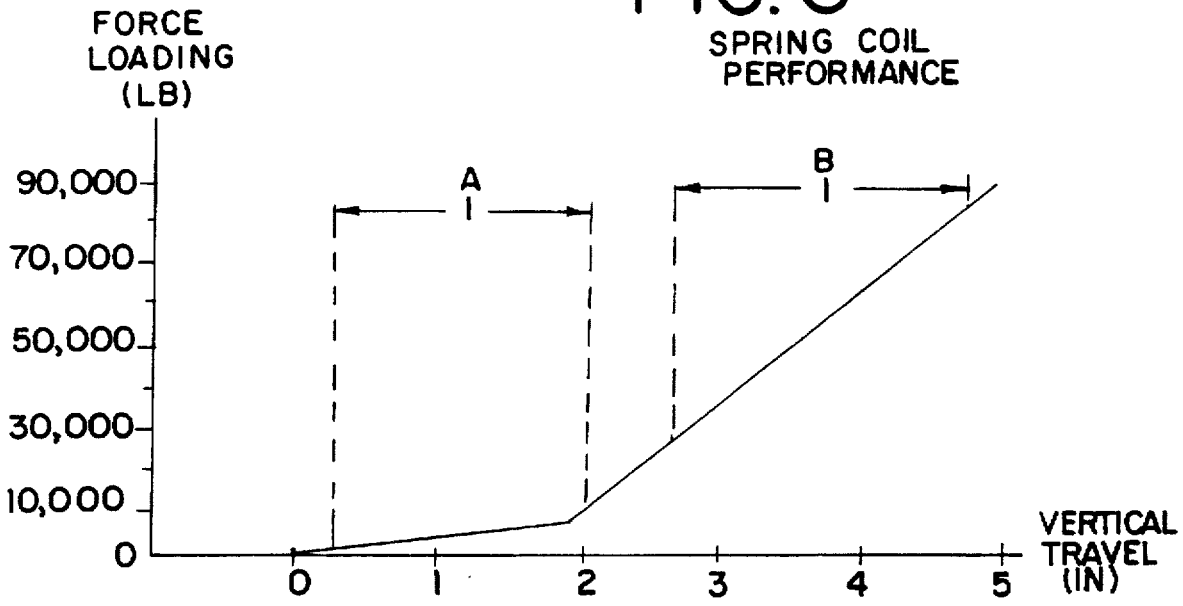
FIG. 6 is a graph of the performance of the conventional coil spring-friction shoe freight car truck, plotting vertical spring travel v. force loading.

Referring now to FIG. 6 of the drawings, a graph representative of the performance of a conventional coil spring-friction shoe suspension in a railway freight car truck is set forth wherein vertical device travel or compression is plotted against force. Note that for an empty or nearly empty railway freight car, with loading on each coil spring group device at about 10,000 lb., the vertical compression is about 2 in. For fully loaded railway freight cars, the loading on each suspension device is about 50,000 lb., for a nominal 100 ton freight car load. As can be seen in FIG. 6, such loading would result in vertical compression of the coil spring suspension device to about 3.5 in. In service, when exposed to regular oscillations, the elastomeric suspension device would compress and expand about 1.0 in. above and below the 3.5 in. position.

Note that the graph of FIG. 6 indicates the performance curves of a spring coil-friction shoe arrangement. The first performance curve for vertical travel up to about 2 in. is at a slight slope. This is indicative of the performance of the spring coil arrangement that is only slightly compressed during light or no load conditions. Such condition is shown at A in FIG. 6. However, upon full or nearly full railway freight car loading, the second performance curve at a greater slope for travel of up to almost 5 in. or so. Such condition is shown as B in FIG. 6.

Figure 7:
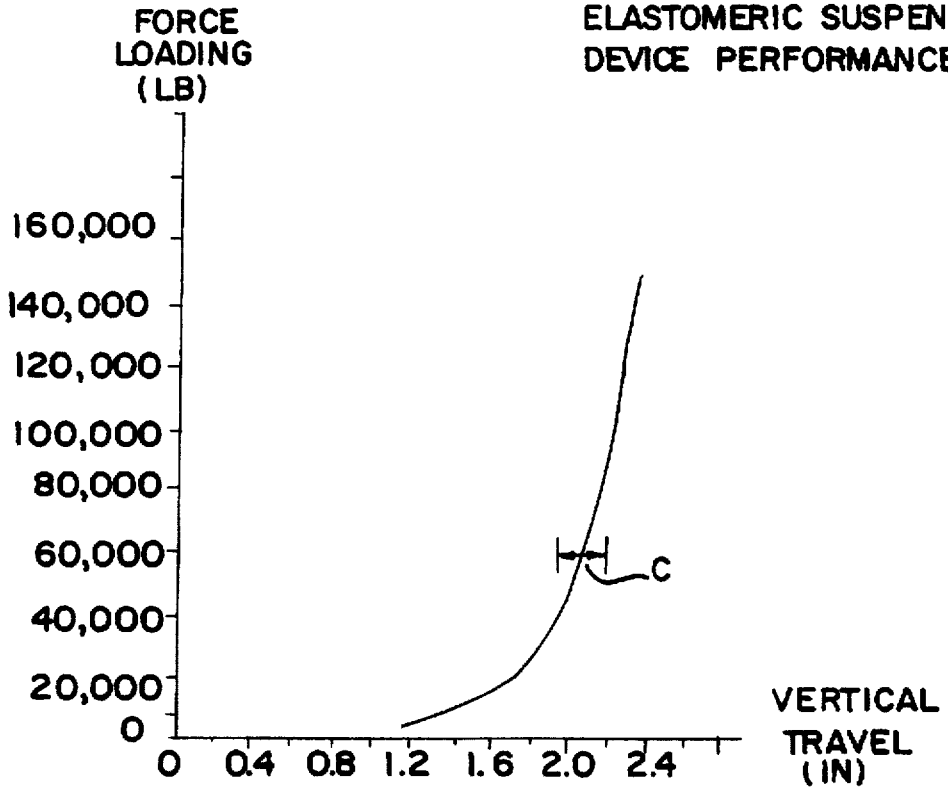
FIG. 7 is a graph of the performance of an elastomeric suspension device freight car truck, plotting vertical device travel v. force loading.

The performance of an elastomeric suspension device of the present invention is shown in FIG. 7. The first performance curve for vertical travel up to about 1.8 in. is at a slight slope. This is indicative of the performance of the elastomeric suspension device that is only slightly compressed during light or no load freight car condition of about 5,000 lb. to 10,000 lb. per suspension group. However, upon full or nearly full railway freight car loading, the second performance curve at a greater slope applies, but note that travel only extends to about 2.2 in. at a loading of about 60,000 lb. per suspension group shown at C in FIG. 7, or a nominal freight car loading of 110 T. Note that this vertical compression is about 2.5 in. less than the conventional coil spring and friction shoe arrangement described for FIG. 6. Hence, the sideframe needed to accommodate the elastomeric suspension device of the present invention could have a bolster opening of about 2.5 in. less vertical height than a conventional sideframe. This would, of course, result in a lower weight sideframe.

The elastomeric suspension device itself of the present invention is usually of a generally toroidal shape and usually with a vertical center axis opening. The elastomeric suspension device could be comprised of a single homogeneous elastomer designed to provide such dual slope performance, or it could be comprised of two separate elastomers, one of a greater stiffness than the other to vertical compression. Such a dual elastomer arrangement could be accomplished by a toroidal structure having an outer toroidal device of a chosen deflection performance surrounding an inner cylindrical device of a second deflection performance.

Another advantage over the conventional coil spring truck is that the coil spring truck and freight car must accommodate an about 2 in. to 5 in. vertical bolster travel from unloaded to fully loaded conditions. This creates several design problems to assure that the freight car can properly perform under normal track and train speed conditions. The truck with the elastomeric suspension device of the present invention need only be designed to accommodate a vertical bolster travel of about 1.25 in. from unloaded to fully loaded conditions. The benefit to freight car performance should be apparent.

Another advantage of the elastomeric suspension device of the present invention when utilized in a freight car truck instead of a coil spring-friction shoe arrangement is shown in comparing B in FIG. 6 to C in FIG. 7. B in FIG. 6 represents the peak to peak vertical spring motion during normal fully loaded freight car operation. Note that such vertical spring motion is about 2.2 in. In a freight car utilizing the elastomeric suspension device of the present invention, such peak to peak vertical elastomeric suspension device motion is shown as C in FIG. 7, or about 0.4 in. under fully loaded car conditions. Again, the benefit to freight car performance should be apparent.

What is claimed is:

1. A railway truck comprising two laterally spaced sideframes, each of said sideframes comprising an upper compression member, two lower tension members and two longitudinally spaced columns each extending between said tension member and said compression member thereby forming a central pocket in each sideframe, and a bottom support member extending longitudinally between said tension members, a bolster extending laterally between said sideframes and having two end sections each of which is received in one of said sideframe central pockets, a spacing structure having a bottom surface and a top surface, the bottom surface of said spacing structure received on an upper surface of said bottom support member of one of said sideframes, and an elastomeric suspension device positioned between said lower surface of said end sections of said bolster and said top surface of said spacing structure, wherein said elastomeric suspension device comprises a generally toroidal shaped body, said body forming a centrally located opening that extends vertically, and wherein said spacing structure comprises outer walls and internal supports to support and space said generally flat bottom and top surfaces, and a first positioning protrusion comprising a generally cylindrical structure that extends upwardly into said centrally located opening in said elastomeric suspension device body section.

2. The railway truck of claim 1 further comprising a second positioning protrusion extending downwardly from a longitudinally central portion of a lower surface of said end section of said bolster, and wherein said second positioning protrusion extends downwardly into said opening in said elastomeric suspension device body.

3. The railway truck of claim 1 wherein said first positioning protrusion extends about one-half of the distance upwardly into said generally cylindrical opening in said elastomeric suspension device body.

4. The railway truck of claim 1 wherein said elastomeric suspension device is vertically compressed about 1.8 in. to about 2.2 in. at a fully loaded condition.

5. The railway truck of claim 1 wherein said elastomeric suspension device is vertically compressed in peak to peak oscillation in a fully loaded condition about 0.4 in.

6. A railway truck comprising two laterally spaced sideframes, each of said sideframes comprising an upper compression member, two lower tension members and two longitudinally spaced columns each extending between said tension member and said compression member thereby forming a central pocket in each sideframe, and a bottom support member extending longitudinally between said tension members, a bolster extending laterally between said sideframes and having two end sections each of which is received in one of said sideframe central pockets, a spacing structure having a bottom surface and a top surface, the bottom surface of said spacing structure received on an upper surface of said bottom support member of one of said sideframes, and an elastomeric suspension device positioned between said lower surface of said end sections of said bolster and said top surface of said spacing structure, wherein said elastomeric suspension device comprises a generally toroidal shaped body, said body forming a centrally located opening that extends vertically, and wherein the top surface of said spacing structure includes a generally concave shaped area to receive said elastomeric suspension device.

* * * * *